US008158900B2

(12) United States Patent
Määttä

(10) Patent No.: US 8,158,900 B2
(45) Date of Patent: Apr. 17, 2012

(54) APPARATUS AND METHOD CONCERNING MODULAR KEYPAD ASSEMBLY

(75) Inventor: Esa-Sakari Määttä, Farnborough (GB)

(73) Assignee: Nokia Corporation, Espoo (FI)

( * ) Notice: Subject to any disclaimer, the term of this patent is extended or adjusted under 35 U.S.C. 154(b) by 357 days.

(21) Appl. No.: 12/387,802

(22) Filed: May 6, 2009

(65) Prior Publication Data

US 2010/0282580 A1 Nov. 11, 2010

(51) Int. Cl.
*H01H 9/00* (2006.01)

(52) U.S. Cl. ..... 200/314

(58) Field of Classification Search ..... 200/314, 200/310; 455/575.1, 575.8; 362/31, 23, 362/24, 26, 27, 29, 86, 88, 602
See application file for complete search history.

(56) References Cited

U.S. PATENT DOCUMENTS 5,746,493 A * 5/1998 Jonsson et al. ..... 362/602
7,511,701 B2 * 3/2009 Nuovo ..... 345/169
7,863,532 B2 * 1/2011 Cao ..... 200/310

* cited by examiner

*Primary Examiner* — Edwin A. Leon

(74) *Attorney, Agent, or Firm* — Harrington & Smith

(57) ABSTRACT

An apparatus that forms or includes a modular keypad the keypad including a replaceable key structure including a set of keys comprising projecting key tops, a replaceable front panel, and a replaceable light guide structure underneath the front panel configured to provide illumination for the modular keypad. A method for assembling a modular keypad is also disclosed.

17 Claims, 6 Drawing Sheets

ETCHED HOLES FOR GRAPHICS IN METAL:

PRINTED GRAPHICS ON BACK SIDE OF PLASTIC PANEL:

PRINTED GRAPHICS ON LIGHT GUIDE:

PRINTED GRAPHICS ON A SEPARATE PART:

APPARATUS AND METHOD CONCERNING MODULAR KEYPAD ASSEMBLY

TECHNICAL FIELD

The present invention generally relates to the user interface of mobile devices. The invention relates particularly, though not exclusively, to modular keypad assemblies of mobile devices.

BACKGROUND ART

Presently, a major challenge in mobile device manufacturing is how to manage keypad variants while keeping logistics and warehousing costs reasonable. Different customers want different colours, materials, and alphabetic systems for keypads, and the number of different combinations of them easily grows large.

SUMMARY

According to a first example aspect of the invention there is provided an apparatus, wherein the apparatus comprises a modular keypad comprising:

a key structure comprising a set of keys comprising projecting key tops, a front panel, and a light guide structure underneath the front panel, the light guide structure comprising a plurality of light guide channels configured to provide illumination for the modular keypad.

Certain embodiments provide a modular keypad with interchangeable features. In certain embodiments it is possible to create numerous variants (e.g., language variants) of keypads with a minimum amount of phone housing variants.

In certain embodiments, the apparatus is a mobile device, such as a mobile station or a mobile phone. In certain embodiments, the apparatus, in fact, is the modular keypad itself. In certain embodiments, the apparatus comprises separate parts configured to form the modular keypad when assembled.

In certain embodiments, the light guide structure is a single piece. For example, it may have been molded as one piece. The light guide structure may comprise a plurality of distinct separate light guide channels. These may have been coupled to each other in an appropriate way.

In certain embodiments, the light guide structure comprises a plurality of separate pieces, each of these pieces having one light guide channel or a plurality of distinct separate light guide channels. The pieces may have been attached or coupled to each other in an appropriate way.

In certain embodiments, the apparatus comprises a supporting frame on top of the replaceable key structure, the supporting frame having openings through which the key tops project.

In certain embodiments, the front panel is a replaceable part. In certain embodiments, the key structure is a replaceable part. In certain embodiments the light guide structure is a replaceable part. In certain embodiments, the front panel, key structure and the light guide structure each are replaceable.

The expression replaceable may be considered such that the part in question is detachably attachable. The expressions defining the position of one part in relation to another part, such as on top of, underneath, and from the back may be considered such that the position of one part in relation to another part is observed in terms of distance from a user interface surface of the apparatus.

In certain embodiments there is provided an integrated light guide system which is interchangeable. In certain embodiments the light guide structure comprises light guide channels (or strips) and a supporting frame.

In certain embodiments, the apparatus comprises a supporting frame comprising grooves for housing light guide channels of the light guide structure, the supporting frame further forming holes for conducting light to the light guides channels from at least one light source. By placing the light guides in the grooves of the frame in some embodiments, light leakage through clearances between key tops and the front panel acting as a graphics panel may be prevented. Also this arrangement keeps the light guides from interfering with movement of the key tops for example when these two parts are physically separated by a wall of the groove.

In certain embodiments, the light guide channels comprise projecting parts to fit the holes in the supporting frame.

In certain embodiments, the apparatus comprises a key mat comprising projecting key tops to form the replaceable key structure.

In certain embodiments, the key mat comprises key tops attached on a sheet made of elastomeric material. In an embodiment the sheet may be a rubber sheet or a rubber membrane. It may be made of silicone, polyurethane, or any flexible, elastomeric material. The sheet may be made for example by injection molding.

The key tops may be made for example of metal, ceramics, glass, sapphire, precious stones, wood, or plastic.

The frame part may be made for example of metal, using casting, machining, forging, MIM (metal injection molding), or a combination of these. Alternatively, it may be made of plastic for example by molding.

The light guide structure (or light guide) may be made of a transparent light-conductive plastic, such as PC, acrylic, SAN, or similar by for example injection molding.

In certain embodiments, the front panel forms:

a graphics panel with openings or holes defining the graphics, or a graphics panel with graphics printed on it.

The front panel may be or form a graphics panel with graphics etched to it as holes. Alternatively, the holes or openings may in some embodiments have been created by a laser. The graphics panel may be made for example of plastic, glass (which may be ordinary glass, hardened glass or crystal glass), ceramics, sapphire, metal, textile, leather, or wood. The graphics panel may be a separate part.

In certain embodiments, the front panel is configured to be attached to the supporting frame by snap fit.

In certain embodiments, the front panel is an interchangeable panel with graphics on it, a graphics panel. This panel may be snapped on a keypad module without tools on production line or in service points. An advantage of having the graphics panel (or part) separate from other parts of the keypad assembly is that handset variants for different countries (due to the different alphabetic systems, language etc.) may be manufactured more economically by simply using a different graphics part. The cost of this part, which typically is the part most easily damaged, can be minimized. A damaged end product can be mended easily, and an end product can be updated easily.

In certain embodiments, the front panel comprises graphics to be illuminated. The graphics may be illuminated from front or back. In the embodiment of backlit, the graphics may be illuminated from the back with the aid of the light guide structure. The graphics panel may enclose a set of transparent light guides which are interchangeable. By replacing the light guide with a different colour one, it is possible to change the colour of the graphics without changing the light source.

In certain embodiments, the apparatus comprises a supporting frame on top of the key structure, the light guide structure on top of the supporting frame, and the front panel on top of the light guide structure.

In a specific embodiment, there is provided a modular keypad structure comprising four distinct parts, in the following order from bottom to top:

- a key mat, comprising key tops attached on a rubber membrane;
- a supporting frame with openings through which key tops project, grooves for housing light guide strips, and holes for conducting light to the light guides;
- light guide strips, with projecting parts adapted to fit the holes in the supporting frame, and
- a metallic graphics panel with graphics etched to it as holes.

In an alternative embodiment, the graphics panel may be made of plastic with graphics printed on it. In a yet alternative embodiment, the graphics may be directly printed on the light guides.

According to a second example aspect of the invention there is provided a method comprising:

assembling a modular keypad from distinct parts comprising a key structure, a supporting frame, a light guide structure, and a front panel, the method comprising:

attaching the parts to each other by placing them in relation to each other such that in a completed assembly the supporting frame is on top of the key structure, the light guide structure is on top of the supporting frame, and the front panel is on top of the light guide structure.

The light guide structure may be configured to provide illumination for the modular keypad as assembled.

In certain embodiments, the parts are attached to each other in the following temporal order:

(i) attaching the light guide structure into the supporting frame;

(ii) attaching the front panel into the supporting frame;

(iii) attaching the key structure into a sub-assembly comprising the supporting frame, the light guide structure and the front panel.

In certain embodiments, the parts are attached to each other in the following temporal order:

(i) attaching the key structure into the supporting frame;

(ii) attaching the light guide structure into the supporting frame;

(iii) attaching the front panel into the supporting frame.

In order to produce the key structure, which may also be called a key top assembly or a key top structure, key tops may be beforehand attached on a sheet made of elastomeric material.

In other embodiments, other ways of assembling may be provided.

In certain embodiments, a completed modular keypad is assembled to a housing in a mobile device. In certain embodiments, the modular keypad is assembled to a mobile phone housing in the final assembly of a production line. The modular structure of the keypad enables Assembly-To-Order principles to be used in mobile device production.

Different non-binding exemplary aspects and embodiments of the present invention have been illustrated in the foregoing. The above embodiments are used merely to explain selected aspects or steps that may be utilized in implementations of the present invention. Some embodiments may be presented only with reference to certain exemplary aspects of the invention. It should be appreciated that corresponding embodiments may apply to other exemplary aspects as well.

BRIEF DESCRIPTION OF THE DRAWINGS

The invention will be described, by way of example only, with reference to the accompanying drawings, in which.

DETAILED DESCRIPTION

In the following description, like numbers denote like elements.

Figure 1:
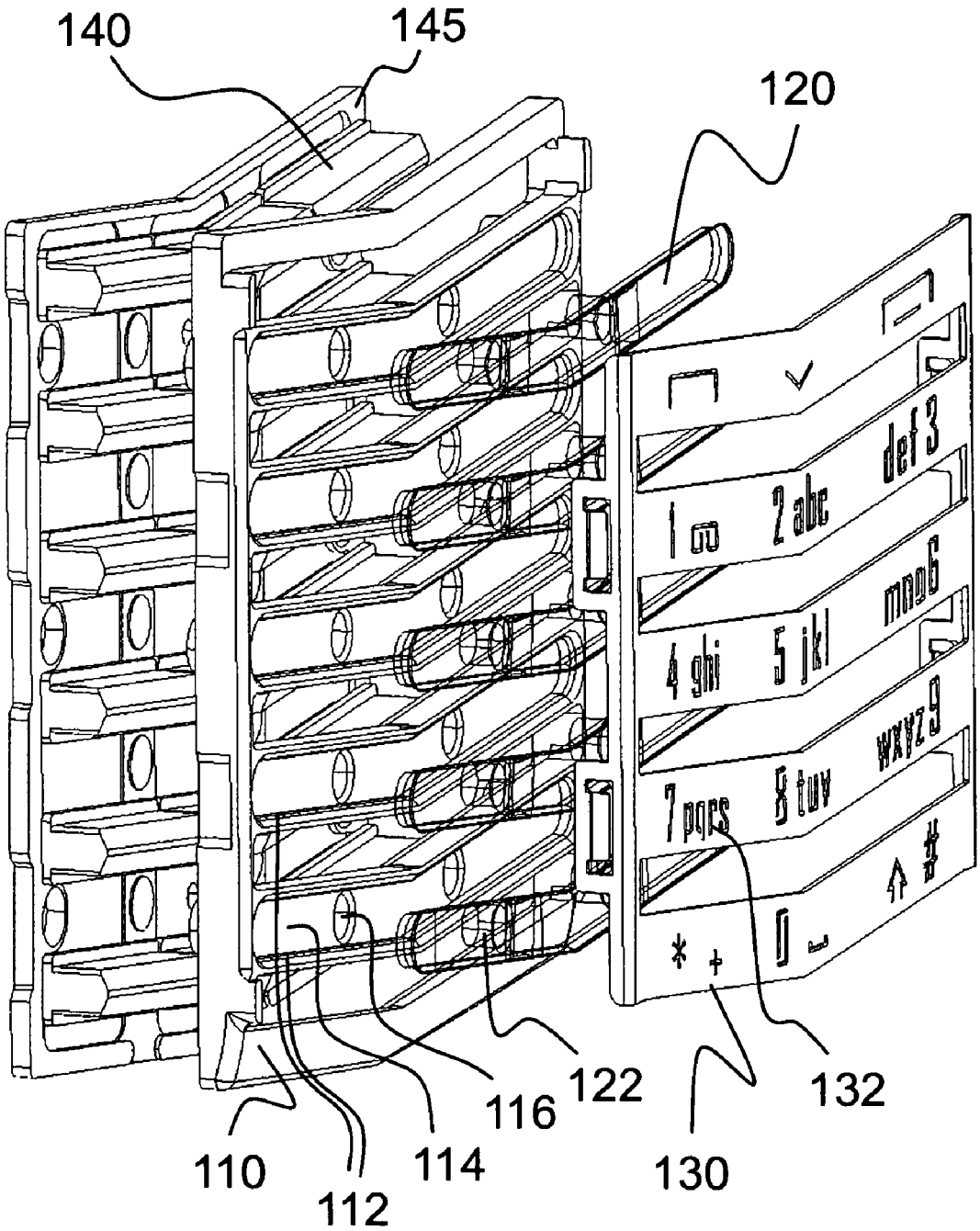
FIG. 1 shows parts of a modular keypad in accordance with an embodiment in an exploded view.

FIG. 1 shows, in an exploded view, parts of a modular keypad for a mobile device in accordance with an embodiment. The modular keypad comprises a keypad module frame 110, a set of light guides 120 that provide light channels, a graphics panel 130, and a key top assembly comprising key tops 140 on a base, such as a rubber membrane 145. The graphics panel 130 may serve as the front panel of the device.

In the keypad module frame 110 there are braces 112 across the frame 110. The braces 112 are separating rows of key tops 140 from each other. The braces 112 have a groove or cavity 114 on the front side of the part 110 in order to accommodate the light guides 120. Each light guide 120 has one or more light pipes or protrusions 122 to fit into holes 116 in the frame part 110. Each light pipe or protrusion 122 collects light from a light source (not shown in FIG. 1) and distributes it towards key graphics 132. The key graphics 132 may comprise, for example, transparent characters formed by perforations.

Figure 2:
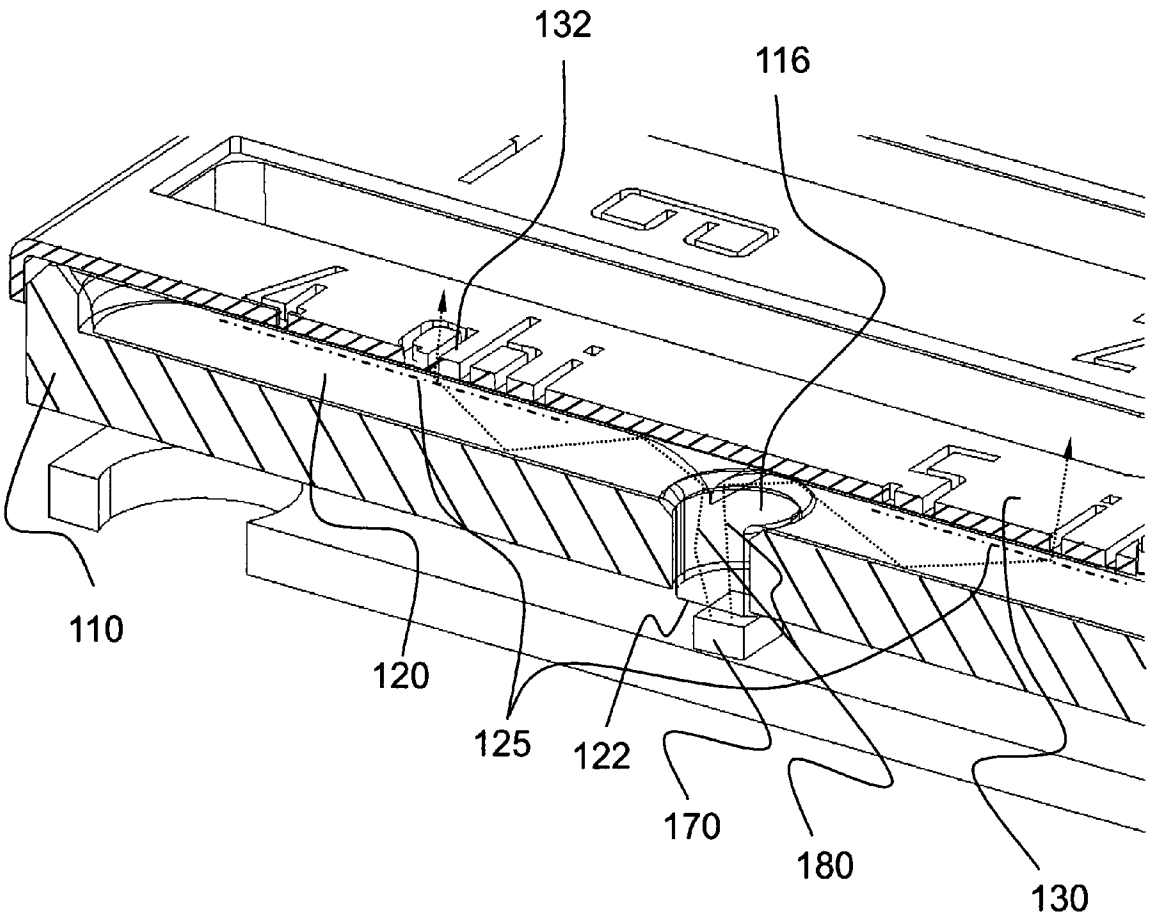
FIG. 2 shows a light guide system in an assembled keypad module in accordance with an embodiment in a section view.

FIG. 2 shows a light guide system in an assembled keypad module in accordance with an embodiment in a section view. The protrusion 122 of the light guide 120 collects light from a light source, such as a led 170. Beams of light 180 received from the light source 170 propagate in the light guide 120 and reflect from light guide edges. At area of the graphics 132 the light guide 120 has a prismatic surface structure 125 in order to guide the light out of the light guide 120 and through the graphics 132. The light guided out of through the prismatic structure 125 on the light guide 120 thus causes an illuminating effect of the graphics 132.

FIGS. 3A-3D show different exemplary ways to implement graphics in accordance with certain embodiments. In the embodiment shown in FIG. 3A the graphics is implemented via a pattern of holes or openings 134 arranged in the graphics panel 130. In an embodiment the holes 134 extend through the graphics panel 130, and the holes 134 have been arranged by etching them in the panel 130 made of metal or another suitable material.

If the graphics panel 130 is, for example, made of plastic the graphics can be printed on it. This is illustrated in the embodiment shown in FIG. 3B. Therein the printed graphics 136 is comprised by the back side of the graphics panel 130. When the light 180 propagates out from the light guide 120 through the printed graphics 136, the user sees the graphics illuminated. For the illuminating effect, the graphics panel 130 should, in this embodiment, be at least partially transparent.

Figure 3A:
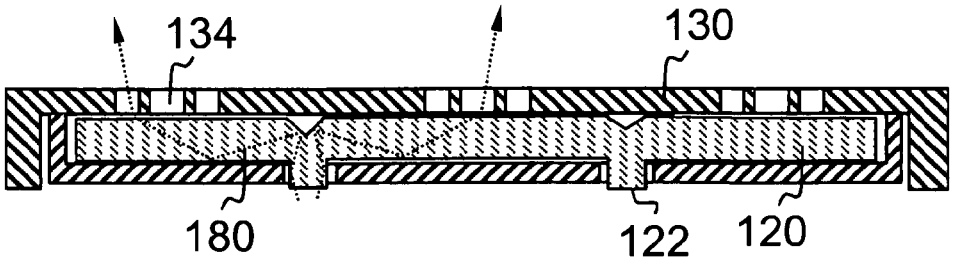
FIGS. 3A-3D show different exemplary ways to implement graphics in accordance with certain embodiments.
Figure 3B:
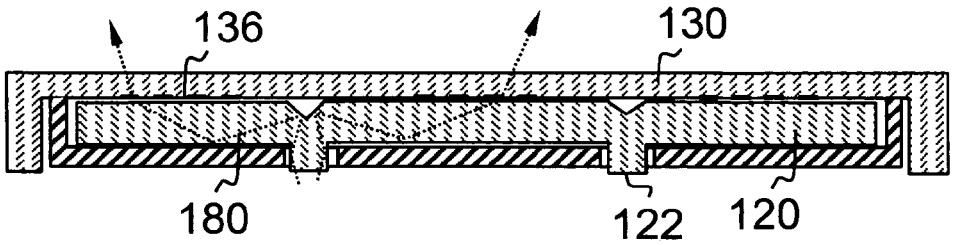
Figure 3C:
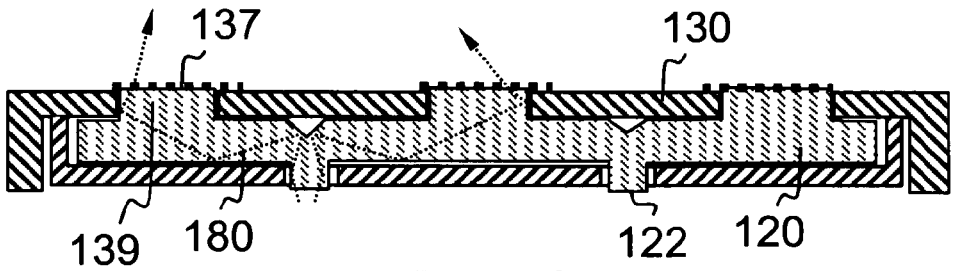

In another embodiment illustrated in FIG. 3C, the graphics is integrated in the light guides 120. In this embodiment, the printed graphics 137 is comprised by the front side of the light guides 120. In this embodiment, the graphics panel 130 has holes 139 large enough to accommodate the area of printed graphics 137. When the light 180 propagates out from the light guide 120 via holes 139 through the printed graphics 137, the user sees the graphics illuminated.

Figure 3D:
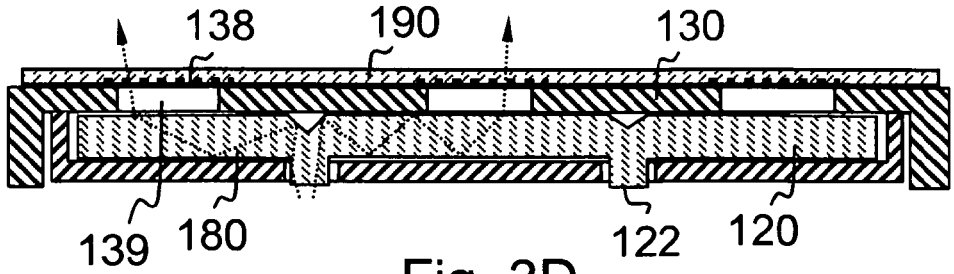

In another embodiment illustrated in FIG. 3D, the graphics is printed on a separate part (or parts) 190. The separate part 190 is attached to the graphics panel 130. It may be attached on top of the panel 130. When the light 180 propagates out from the light guide 120 via holes 139 through the printed graphics 138, the user sees the graphics illuminated. In yet another embodiment, the light guides 120 may have protrusions that extend through the holes 139 up to the separate part 190 thus leaving substantially no open space between the light guide and the separate part 190.

Figure 4:
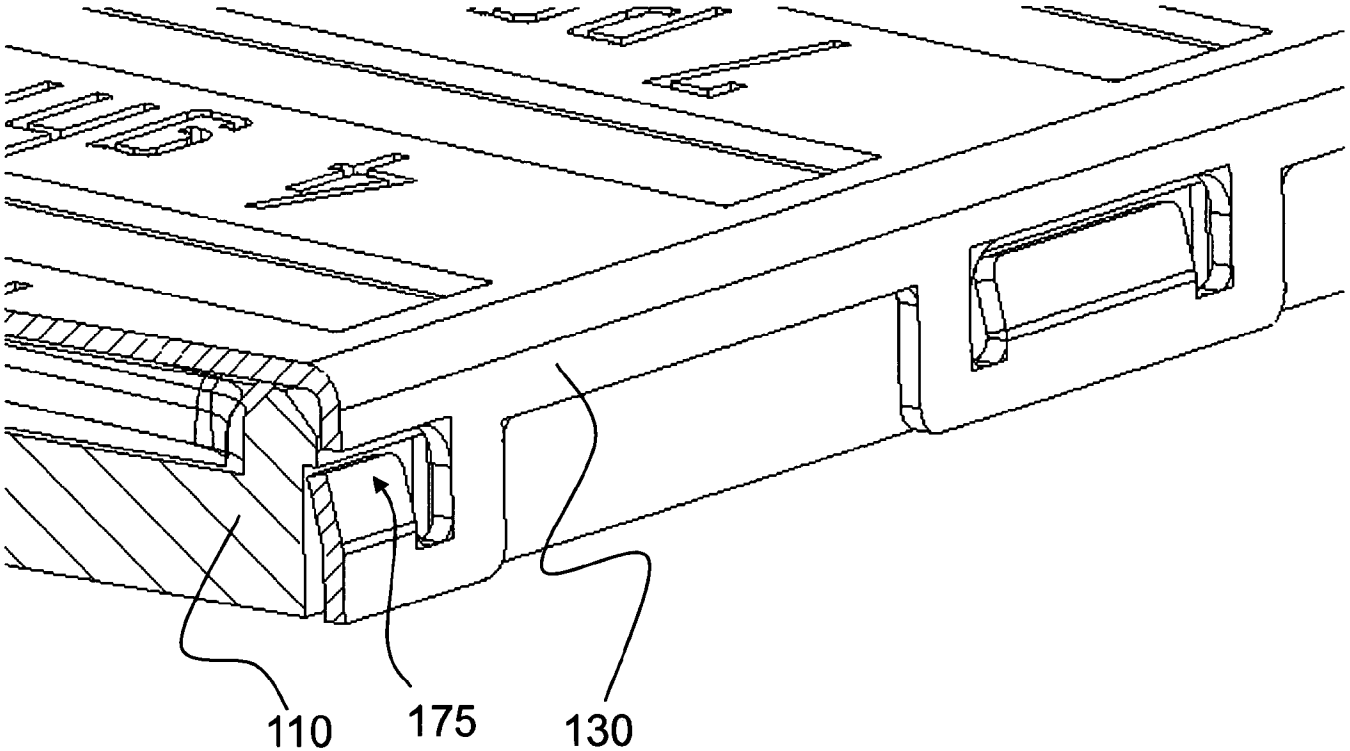
FIG. 4 shows a snap fit system of a graphics panel in accordance with an embodiment.

FIG. 4 shows a snap fit system of a graphics panel in accordance with an embodiment. The graphics panel 130 with transparent characters is placed over the front face of the keypad module frame 110. On the sides there are snap fits 175 for easy assembly and disassembly. The graphics panel 130 can be assembled and replaced on the keypad module as necessary.

Figure 5:
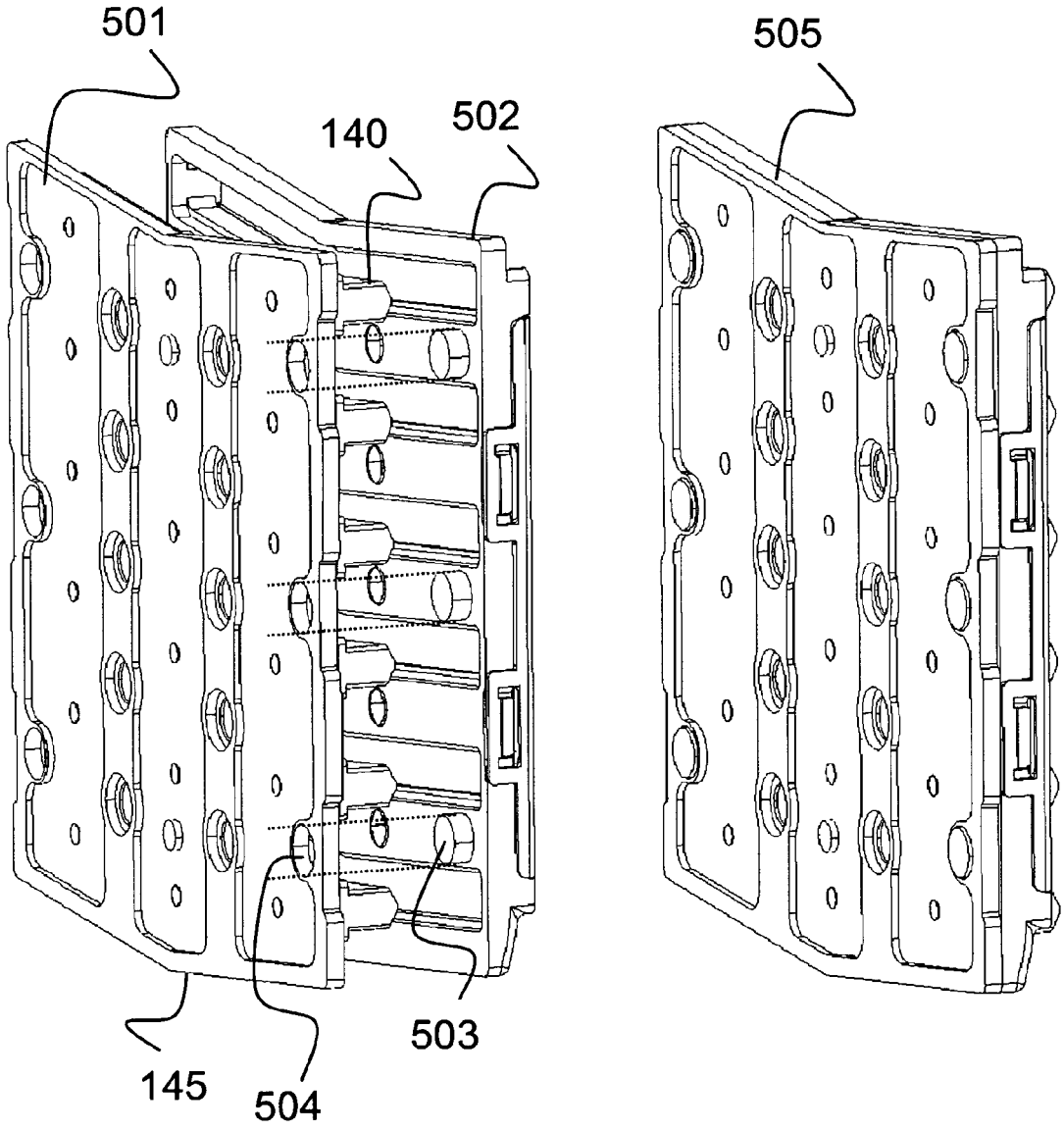
FIG. 5 shows the assembling of key tops and a rubber membrane in accordance with an embodiment.

FIG. 5 shows the assembling of key tops and a rubber membrane in accordance with an embodiment. In this embodiment, a keypad module 505 is completed from a key top assembly 501 and a keypad frame assembly 502. The key top assembly 501 comprises key tops 140 on a base, here a rubber membrane 145. The key top assembly 501 is assembled from backside and secured with the rubber membrane which fits around location features, such as membrane locators 503. The key tops 140 project through the keypad frame assembly part 502.

A membrane locator 503 may be a protrusion in the keypad frame assembly 502 around which the key top assembly 501 tightly fits on its holes 504 or similar. Alternatively, the key top assembly 501 may comprise protrusions around which the keypad frame assembly 502 tightly fits. The rubber membrane provides sealing against liquids and dust ingression into the product interior. Debris can slip in through running clearances around the keys on top of the rubber membrane but practically no further.

The completed keypad module 505 is assembled to a mobile phone housing or similar in final assembly of production line.

Figure 6:
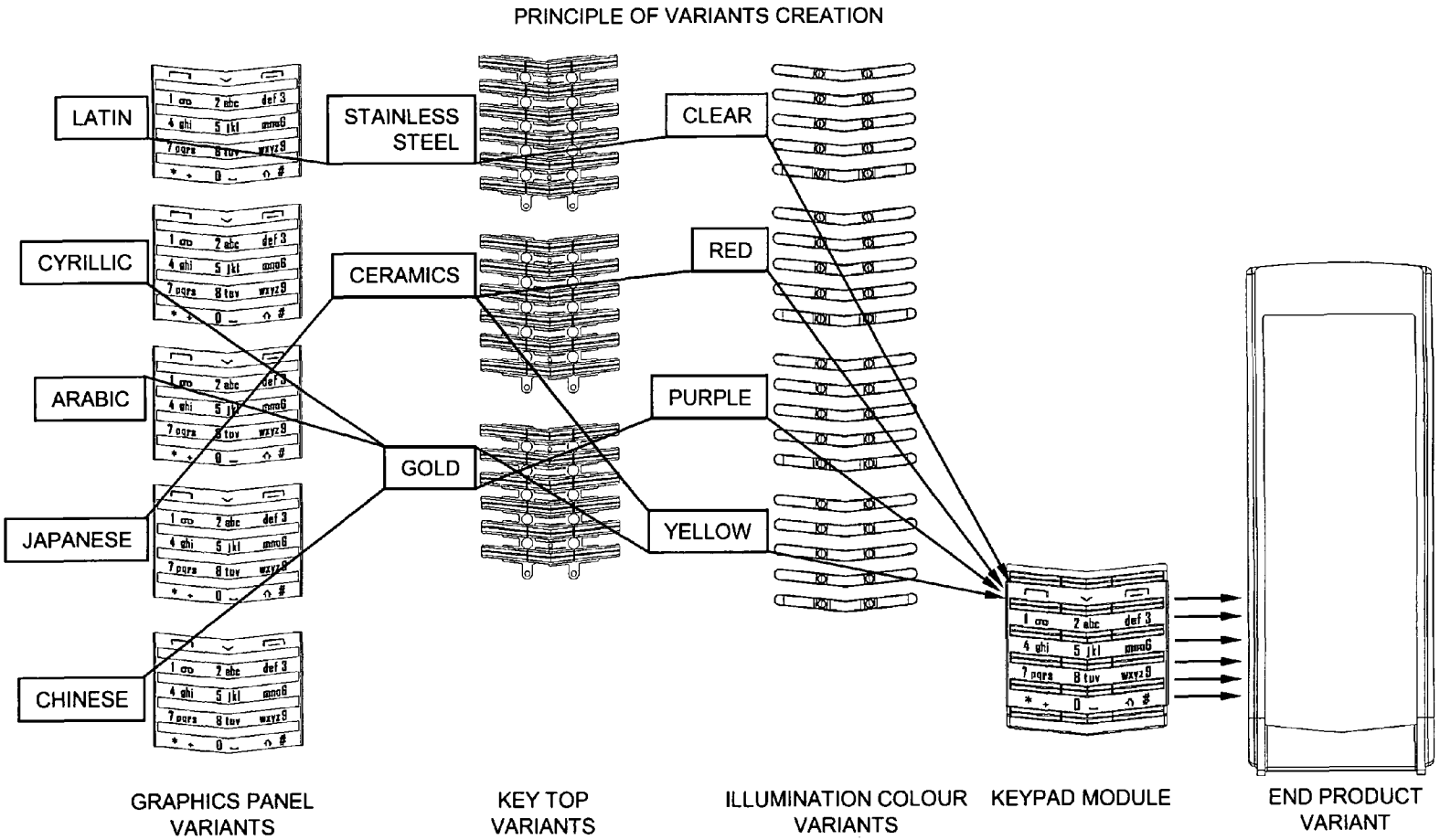
FIG. 6 shows a simplified principle of variants creation in accordance with an embodiment.

FIG. 6 shows a simplified principle of variants creation in accordance with an embodiment. It is possible to create numerous variants of keypads with minimum amount of phone housing variants. In am embodiment, a modular keypad for a mobile device or phone is assembled from a selected graphics panel variant, with a selected key top variant, a selected light guide system variant (different graphics illumination colour variant). The selected graphics panel variant, key top variant and light guide system variant is attached to a keypad module frame to form a keypad module. The keypad module is attached to the mobile device or phone to produce an end product variant.

The foregoing description has provided by way of non-limiting examples of particular implementations and embodiments of the invention a full and informative description of the best mode presently contemplated by the inventors for carrying out the invention. It is however clear to a person skilled in the art that the invention is not restricted to details of the embodiments presented above, but that it can be implemented in other embodiments using equivalent means or in different combinations of embodiments without deviating from the characteristics of the invention.

Furthermore, some of the features of the above-disclosed embodiments of this invention may be used to advantage without the corresponding use of other features. As such, the foregoing description shall be considered as merely illustrative of the principles of the present invention, and not in limitation thereof. Hence, the scope of the invention is only restricted by the appended patent claims.

The invention claimed is:

1. An apparatus, wherein the apparatus comprises a modular keypad comprising:

a key structure comprising a set of keys comprising projecting key tops, a front panel, a light guide structure underneath the front panel, the light guide structure comprising a plurality of light guide channels configured to provide illumination for the modular keypad, and a supporting frame comprising grooves for housing light guide channels of the light guide structure, the supporting frame further forming holes for conducting light to the light guide channels from at least one light source of the apparatus.

2. The apparatus according to claim 1, wherein the front panel is a replaceable part.

3. The apparatus according to claim 1, wherein the key structure is a replaceable part.

4. The apparatus according to claim 1, wherein the light guide structure is a replaceable part.

5. The apparatus according to claim 1, wherein the apparatus is a modular keypad or is configured to form a modular keypad.

6. An apparatus according to claim 1, comprising a supporting frame on top of the key structure, the supporting frame having openings through which the key tops project.

7. An apparatus according to claim 1, wherein the light guide channels comprise projecting parts to fit the holes in the supporting frame.

8. An apparatus according to claim 1, comprising a key mat comprising projecting key tops to form the replaceable key structure.

9. An apparatus according to claim 8, wherein the key mat comprises key tops attached on a sheet made of elastomeric material.

10. An apparatus according to claim 1, wherein the front panel is configured to be attached to a supporting frame by snap fit.

11. An apparatus according to claim 1, wherein the front panel comprises graphics to be illuminated from the back with the aid of the light guide structure.

12. An apparatus according to claim 1, wherein the front panel forms:

a graphics panel with openings or holes defining the graphics, or a graphics panel with graphics printed on it.

13. An apparatus according to claim 1, comprising a supporting frame on top of the key structure, the light guide structure on top of the supporting frame, and the front panel on top of the light guide structure.

14. An apparatus according to claim 1, wherein the apparatus is a mobile device.

15. A method of assembling the apparatus of claim 1 comprising:

attaching the key structure, the front panel, the light guide structure and a supporting frame to each other by placing them in relation to each other such that the supporting frame is on top of the key structure, the light guide structure is on top of the supporting frame, and the front panel is on top of the light guide structure.

16. A method according to claim 15, wherein the parts are attached to each other in the following temporal order:

(i) attaching the light guide structure into the supporting frame;

(ii) attaching the front panel into the supporting frame;

(iii) attaching the key structure into a sub-assembly comprising the supporting frame, the light guide structure and the front panel.

17. A method according to claim 15, wherein the parts are attached to each other in the following temporal order:

(i) attaching the key structure into the supporting frame;

(ii) attaching the light guide structure into the supporting frame;

(iii) attaching the front panel into the supporting frame.

* * * * *